US006113200A

United States Patent [19]

Slivon

[11] Patent Number: 6,113,200

[45] Date of Patent: Sep. 5, 2000

[54] COMPARTMENT WITH VERTICAL DRAWERS AND STRUCTURE FOR ALLOWING ONLY ONE VERTICAL DRAWER TO BE OUTSIDE COMPARTMENT AT A TIME

[75] Inventor: George R. Slivon, Kenosha, Wis.

[73] Assignee: Snap-on Tools Company, Kenosha, Wis.

[21] Appl. No.: 09/318,922

[22] Filed: May 26, 1999

[51] Int. Cl.[7] ..... E05B 53/00

[52] U.S. Cl. ..... 312/218; 312/221; 312/333

[58] Field of Search ..... 312/216, 217, 312/218, 221, 222, 215, 333, 334.23, 334.24, 334.25, 334.26, 334.27, 334.28, 334.29, 334.3, 334.31, 334.32, 334.33; 292/DIG. 18

[56] References Cited

U.S. PATENT DOCUMENTS

| | | | |
|---|---|---|---|
| 2,848,293 | 8/1958 | Jurgens et al. | 312/333 X |
| 3,404,929 | 10/1968 | Wright et al. . | |
| 3,799,639 | 3/1974 | Friend . | |
| 3,874,755 | 4/1975 | Hegg et al. . | |
| 3,883,200 | 5/1975 | Latham . | |
| 3,888,558 | 6/1975 | Himsl . | |
| 4,239,309 | 12/1980 | De Fouw et al. . | |
| 4,272,138 | 6/1981 | Stark . | |
| 4,303,287 | 12/1981 | Taplin . | |
| 4,394,056 | 7/1983 | Janke . | |
| 4,478,466 | 10/1984 | Clark et al. . | |
| 4,889,396 | 12/1989 | Mitchell et al. . | |
| 4,966,422 | 10/1990 | Albright et al. . | |
| 4,966,423 | 10/1990 | Higuera et al. . | |
| 4,993,784 | 2/1991 | Dana et al. . | |
| 5,197,686 | 3/1993 | Okada et al. . | |
| 5,303,994 | 4/1994 | Elsholz . | |
| 5,333,949 | 8/1994 | McGregor . | |
| 5,411,327 | 5/1995 | Norton . | |
| 5,427,445 | 6/1995 | Mitchell . | |
| 5,567,027 | 10/1996 | McClung et al. . | |
| 5,599,078 | 2/1997 | Dechene et al. . | |
| 5,702,167 | 12/1997 | Müller . | |

FOREIGN PATENT DOCUMENTS

| | | | |
|---|---|---|---|
| 2173463 | 10/1973 | France | 312/221 |

*Primary Examiner*—Janet M. Wilkens
*Attorney, Agent, or Firm*—Seyfarth Shaw

[57] ABSTRACT

A cabinet is provided which includes wall structure defining an open-faced compartment containing a plurality of upright drawers or panels mounted in the compartment for movement from a first position totally within the compartment to a second position extending out of the compartment. The cabinet includes a lock bar movable between unlocked and locked positions, wherein in the locked position the lock bar prevents drawers disposed in the first position from moving to the second position and biasing structure coupled to the lock bar and resiliently urging the lock bar toward the unlocked position. The lock bar moves to its locked position in response to movement of a drawer to its second position.

20 Claims, 7 Drawing Sheets

50
50
50
51
51
70
70
60
74
72
68
98
98
98
96
A
33
68
72

COMPARTMENT WITH VERTICAL DRAWERS AND STRUCTURE FOR ALLOWING ONLY ONE VERTICAL DRAWER TO BE OUTSIDE COMPARTMENT AT A TIME

BACKGROUND OF THE INVENTION

1. Field of the Invention

This invention relates to storage cabinets, and more particularly, to vertically-oriented drawers for such cabinets.

2. Description of the Prior Art

Typically tool chests or cabinets are provided with horizontally arranged shelves, drawers, trays and the like for containing or supporting tools or other items. These horizontal drawers can sometimes make it difficult for the user, such as an automotive mechanic or the like, to readily see or gain access to the contents of a drawer.

It has also been known to provide cabinets with vertically-arranged drawers or storage units which can be slidably moved between closed positions within the cabinet and open positions extending from the cabinet, and on which items may be hung or clipped. These drawers are typically all arranged together in the upper portion of the cabinet. If more than one drawer is extended from the cabinet, the cabinet may become unstable and possibly tip over causing damage to the cabinet contents or a user.

SUMMARY OF THE INVENTION

It is a general object of the invention to provide an improved storage chest or cabinet which avoids the disadvantages of prior chests or cabinets while affording additional structural and operating advantages.

An important feature of the invention is the provision of a storage cabinet which is of relatively simple and economical construction.

A still further feature of the present invention is a storage cabinet which includes a plurality of upstanding vertical drawers and which has structure inhibiting the storage cabinet from tipping over.

Certain ones of these and other features of the invention may be attained by providing a cabinet comprising wall structure defining an open-faced compartment, and a plurality of drawers movably disposed in the compartment. The drawers are movable from a first position totally within the compartment to a second position extending out of the compartment. A lock bar is movable between unlocked and locked positions, wherein in the locked position the lock bar prevents drawers disposed in the first position from moving to the second position, and biasing structure coupled to the lock bar urges the lock bar toward the unlocked position. An actuation mechanism responsive to movement of a drawer to its second position moves the lock bar to the locked position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
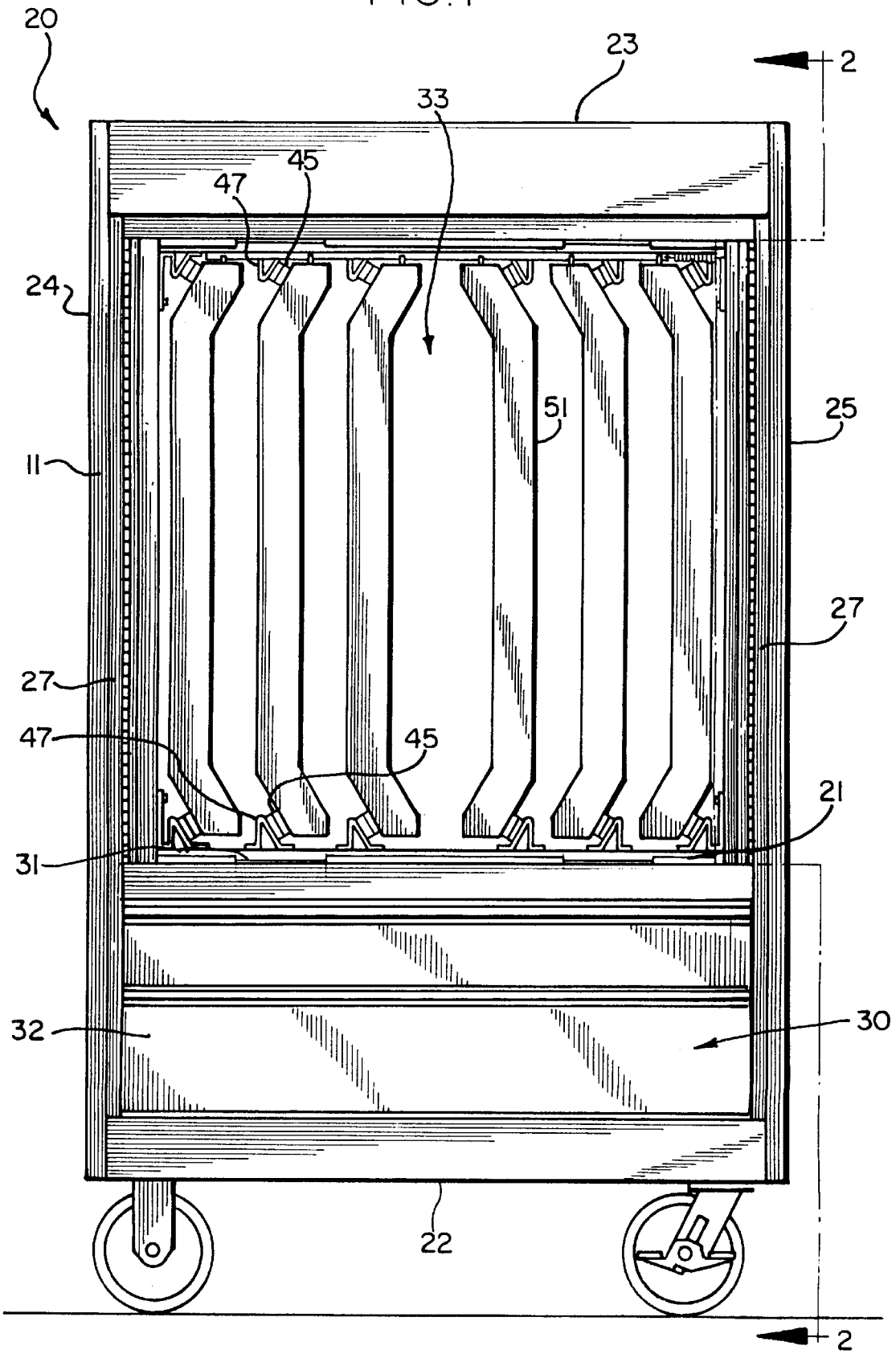
FIG. 1 is a front elevational view of the storage cabinet of the present invention with all drawers closed.

Referring to FIG. 1, there is illustrated a storage chest or tool cabinet, generally designated by the numeral 20, constructed in accordance with and embodying the features of the present invention. The tool cabinet 20 has a generally box-like, upstanding housing 11 including a bottom wall 22, a top wall 23, opposed side walls 24 and 25, and a rear wall 26 (FIG. 2), being closed by front doors (not shown) coupled to a front frame structure 27 in a known manner. The tool cabinet 20 includes a lower storage compartment 30, defined generally between a lower frame member or wall 31 and the bottom wall 22. A plurality of vertically-spaced horizontal drawers 32 are disposed in the lower storage compartment 30 and are mounted for sliding movement on standard ball slide assemblies (not shown) for movement between a closed position, illustrated in FIGS. 1 and 2, disposed entirely within the lower storage compartment 30, and an open position extending from the storage compartment 30 (not shown). The drawers 32 are opened by moving in the direction of the arrow in FIG. 2.

The tool cabinet 20 also has an open-faced upper storage compartment 33 formed by a wall structure including the opposed sidewalls 24, 25, the rear wall 26, and a framework including the lower frame member 31 and an upper frame member 37 mounted beneath the top wall 23, which frame members 31, 37 respectively define the lower and upper ends of the upper storage compartment 33. The upper storage compartment 33 has a front end 34 and a rear end 35 adjacent to the rear wall 26.

Figure 2:
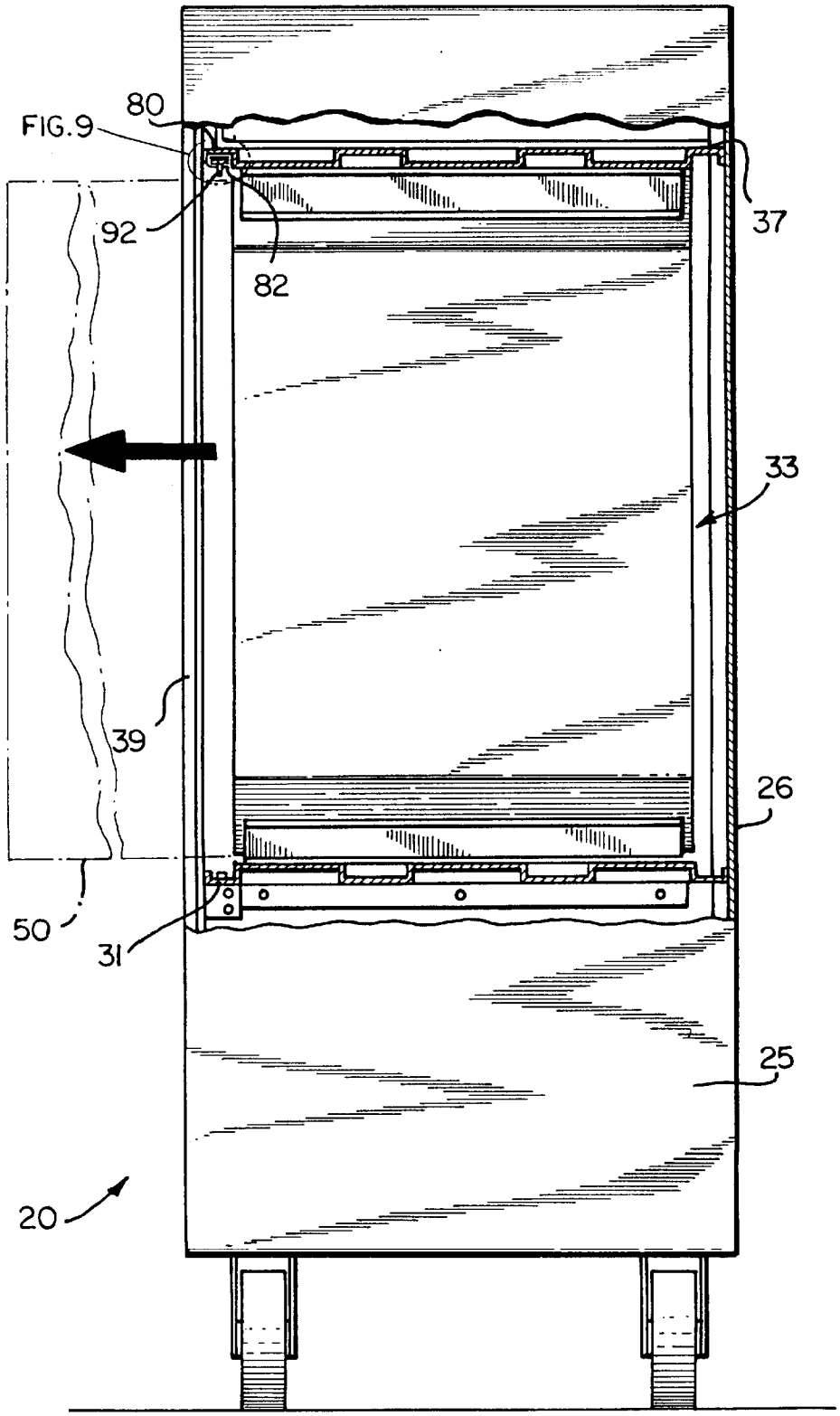
FIG. 2 is a sectional view taken generally along lines 2—2 of FIG. 1 and illustrating the open position of a drawer in phantom.
Figure 3:
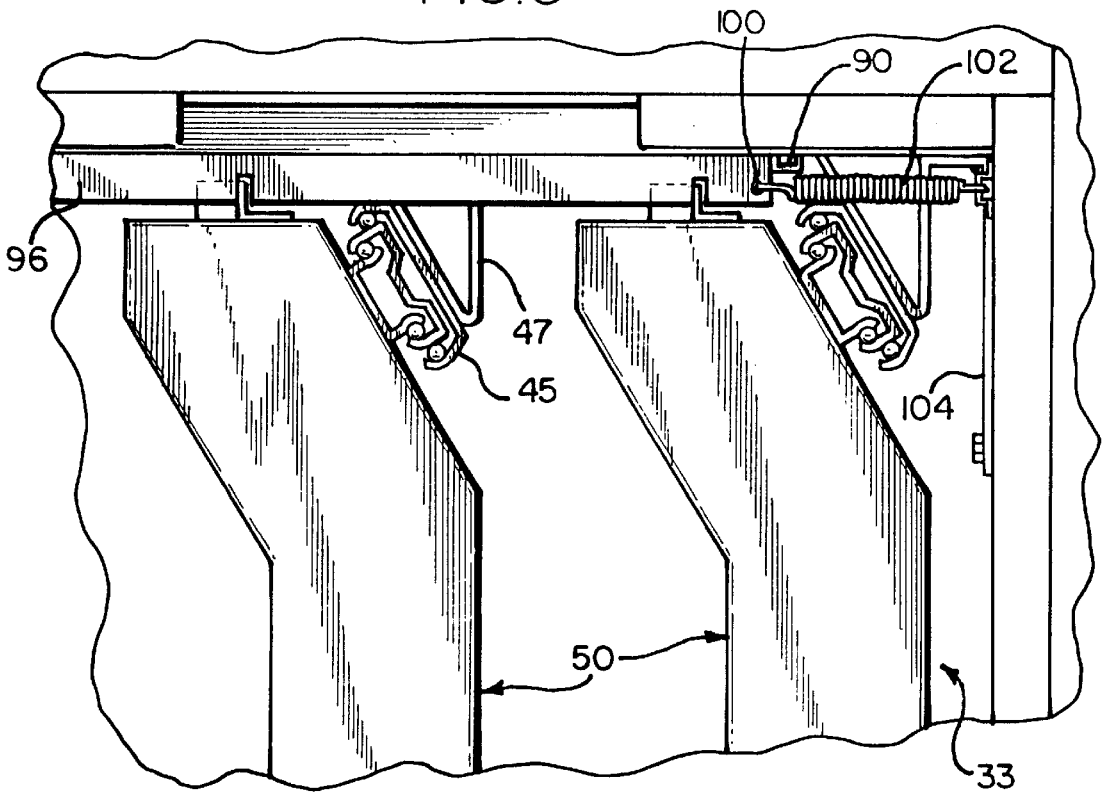
FIG. 3 is an enlarged, fragmentary elevational view of the upper right-hand portion of FIG. 1.
Figure 4:
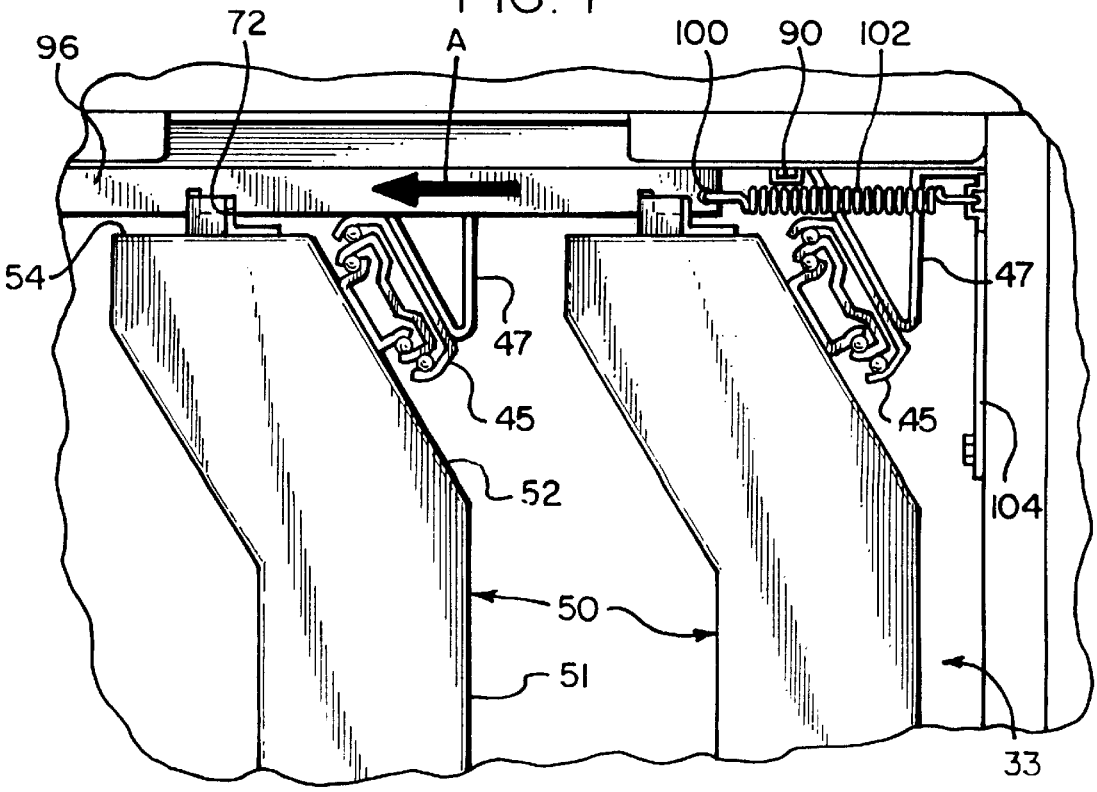
FIG. 4 is a view similar to FIG. 3 with the locking structure in a locked position.
Figure 5:
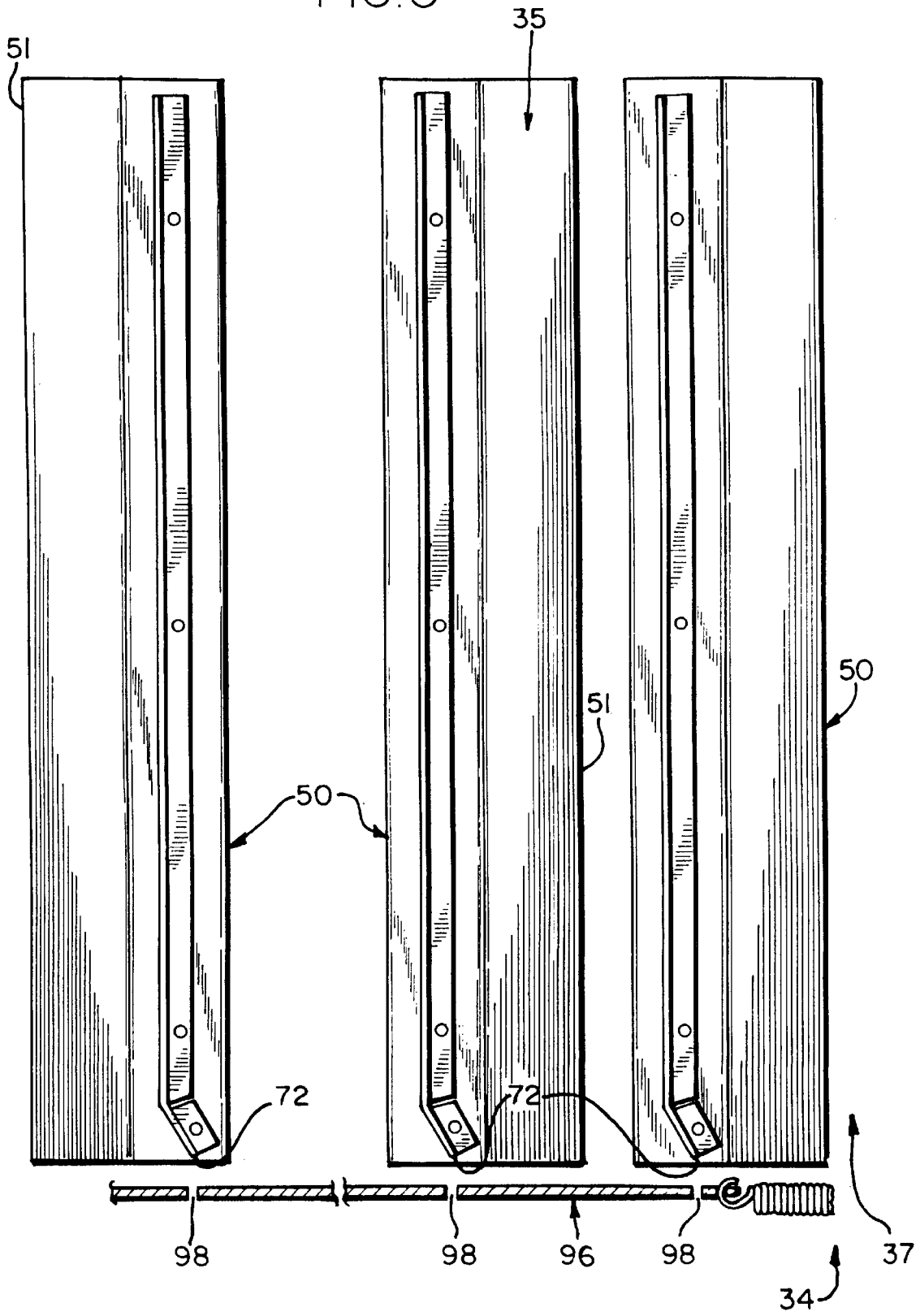
FIG. 5 is a diagrammatic top plan view of the panels and locking structure in an unlocked condition.

Also disposed in the upper storage compartment 33 are six vertically-oriented (or upstanding) drawers or panel assemblies 50. Each drawer 50 is slidable into and out of the open-faced compartment 33 via, as seen in FIGS. 1 and 3–4, vertically-aligned pairs of drawer slide assemblies 45 coupled to the upper and lower ends of the drawer 50 and to slide supports 47 disposed on the upper and lower frame members 37, 31. The drawer slide assemblies 45 and the supports 47 are discussed in greater detail in commonly assigned, co-pending application Ser. No. 09/032,539, entitled "Inclined Slide Assemblies for Vertical Drawers", now U.S. Pat. No. 5,992,956 the disclosure of which is incorporated herein by reference. The drawers 50 are moveable in the direction of the arrow of FIG. 2 between a first position, as seen in FIGS. 1 and 5, totally within the upper storage compartment 33 and a second position, as seen in FIG. 2 (phantom line) and FIG. 6, extending out of the upper storage compartment 33.

Figure 7:
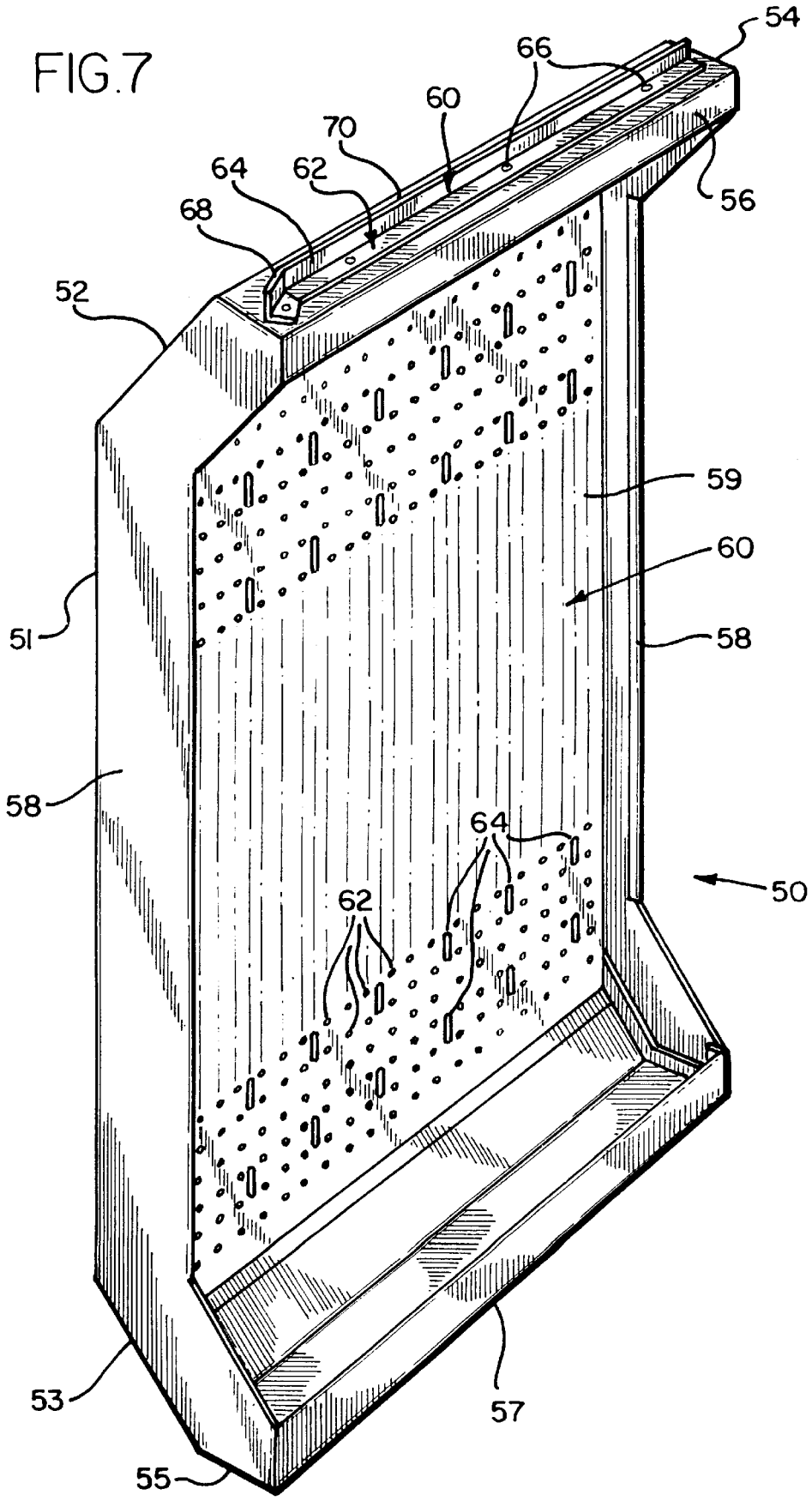
FIG. 7 is a perspective view of one of the panels of FIG. 1.

The drawers 50 are of identical construction, as best seen in FIG. 7, each having a vertical wall 51 (see FIG. 5) arranged parallel to the cabinet sidewalls 24 and 25 and integral at its upper and lower ends with upper and lower inclined walls 52 and 53, which respectively slope upwardly and downwardly in the same lateral direction. The inclined walls 52 and 53 are, respectively, integral at their distal ends with parallel top and bottom walls 54 and 55. The top and bottom walls 54, 55 are, respectively, integral at their distal ends with top and bottom flange walls 56, 57 parallel to vertical wall 51. All of the walls 51–57 are provided at their front and rear ends with attachment flanges to facilitate attachment to end walls 58.

Mounted in the drawer 50 between the inclined walls 52 and 53 is a tool holding panel 59, which has a planar central portion 60 which is perforated with a plurality of substantially uniformly spaced holes 62 and vertically elongated slots 64. The planar central portion 60 is parallel to the vertical wall 51 and is integral at its upper and lower ends with inclined portions which are, respectively, attached to the inclined walls 52 and 53, so that the central portion 60 is spaced from the vertical wall 51. The structure of the drawers 50 is discussed in more detail in copending application Ser. No. 09/032,539, discussed above, and in commonly assigned and copending application Ser. No. 09/263,337, entitled "Vertical Drawer with Catch Basin and Storage Chest Containing Same," the disclosure of which is hereby incorporated by reference.

It will be appreciated that tools can be hung or clipped onto the tool holding panel 59 by any known means. Thus, for example, separate tool holders could be hung on the tool holding panel 59 by the use of suitable hooks, clips, straps, or the like. Alternatively, tools, such as a hammers, or wrenches, or other type tools may be individually mounted by the use of hooks or other supports, including those described above, in a known manner.

As seen in FIG. 1, the three drawers 50 closest to sidewall 24 are oriented in the same manner and have been rotated 180° with respect to the three drawers 50 closest to sidewall 25 to face them in a mirror-image fashion. The drawers 50 can be arranged in other manners depending upon the application.

Each of the drawers 50, has an L-shaped bar 60 coupled to the top wall 54 and having integral first and second legs 62, 64 substantially perpendicular to each other. The first leg 62 is coupled to the top wall 54 of an associated drawer 50 by a plurality of fasteners 66, or by other known means. The second leg 64 projects up from and is substantially perpendicular to the top wall 54 of the drawer 50.

Figure 6:
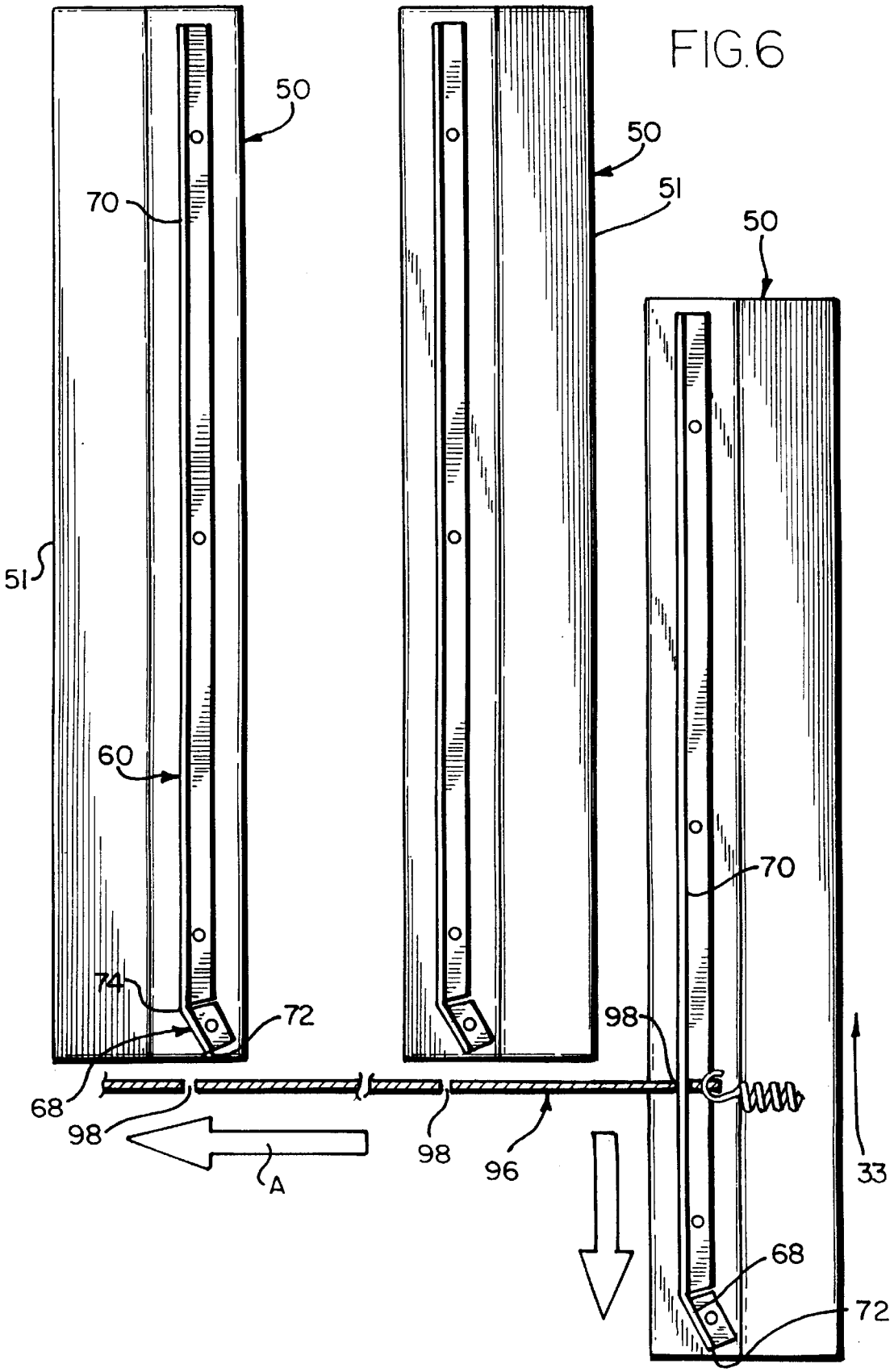
FIG. 6 is a view similar to FIG. 5 illustrating one of the panels extending out of the cabinet and the locking structure in a locked condition.

As seen best in FIG. 6, the second leg 64 has first and second portions 68, 70 inclined with respect to each other. The first portion 68 is disposed closer to the front end 34 of the upper storage compartment 33 when the drawer 50 is in its first position and is shorter than the second portion 70. The second portion 70 is substantially parallel to vertical wall 51. The first portion 68 has a free front end 72 and a rear end 74 connected to the second portion 70. The first portion 68 is inclined so that the front end 72 is closer to the side of the upper storage compartment 33 to which it is coupled (and sidewall 25) than the second end 74.

Figure 8:
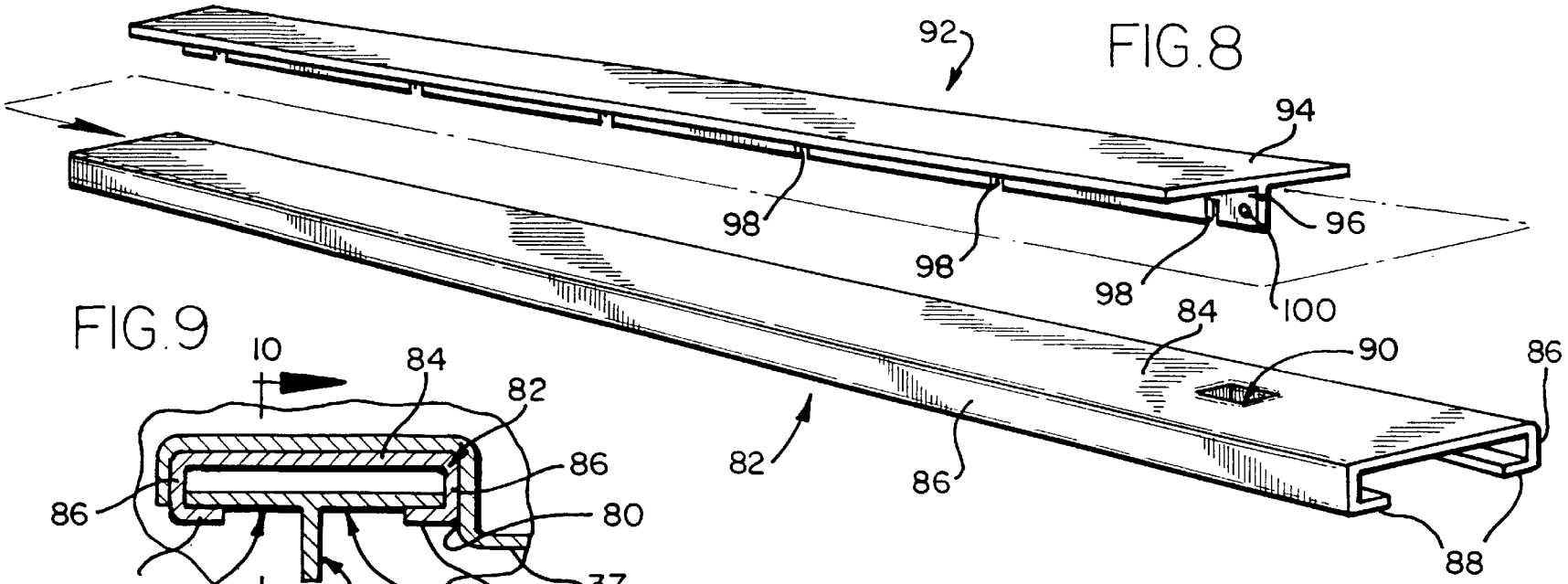
FIG. 8 is an exploded perspective view of the lock bar and channel of the locking structure.
Figure 9:
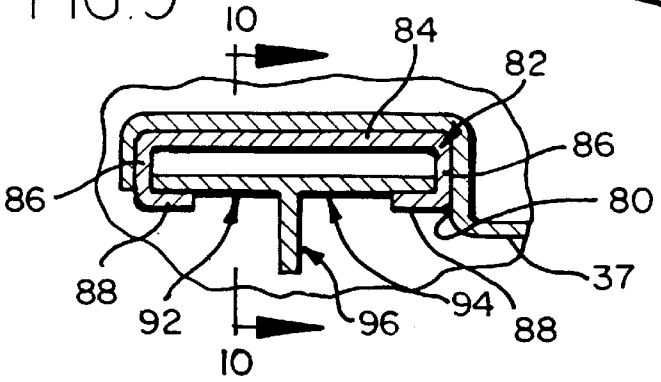
FIG. 9 is an enlarged sectional view of the circled area of FIG. 2.
Figure 10:
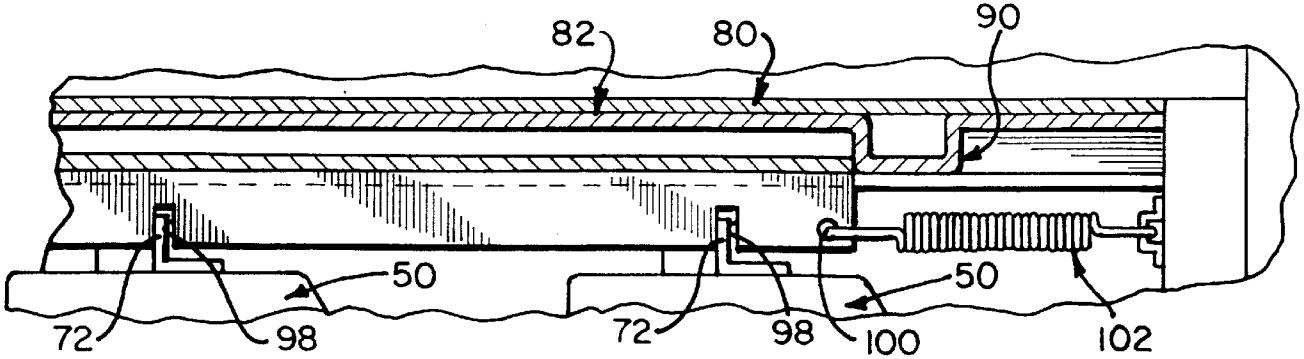
FIG. 10 is a fragmentary, sectional view taken generally along the line 10—10 of FIG. 9.

As seen in FIGS. 2 and 9, the upper frame member 37 forms a downwardly-facing U-shaped channel 80 running along, substantially, the width of the opening of the front end 34 of the upper storage compartment 33. A C-shaped channel 82 is attached to the U-shaped channel 80 by welding or the like. The C-shaped channel 82 has an upper wall 84, two parallel end walls 86 and two spaced-apart bottom walls 88 respectively connected to end walls 86 and parallel to the top wall 84. As seen in FIGS. 8 and 10, the top wall 84 has a U-shaped stop projection 90, projecting down from top wall 84 toward the bottom walls 88.

A one-piece, T-shaped lock/slide bar 92 is slideably disposed in the C-shaped channel 82. The lock/slide bar 92 includes a planar upper slide bar 94 and a lower lock bar 96 coupled to and perpendicular to the slide bar 94. The lock bar 96 has six slots 98 and an aperture 100 at a longitudinal end. As seen best in FIG. 9, the lock/slide bar 92 rests on the bottom walls 88 of the C-shaped channel 82.

As seen in FIGS. 3 and 4, a spring 102 has a first end disposed through aperture 100 in the lock bar 96 and a second end coupled to lock structure 104 coupled to sidewall 25. When all the drawers 50 are totally disposed in the upper storage compartment 33, the spring 102 biases the lock bar 96 to an unlocked position, as seen in FIGS. 1, 3 and 10, where the lock bar 96 is in contact with the stop projection 90 which stops the lock bar 96 in a proper position. When the lock bar 96 is in the unlocked position, the front end 72 of each L-shaped bar 60 is aligned with a respective slot 98 of the lock bar 96 (FIGS. 5 and 10), allowing it and its associated drawer 50 to be moved and extend out of the upper storage compartment 33.

The L-shaped bars 60 of the several drawers 50 cooperate to form an actuation mechanism for the lock bar 96. When, as seen in FIG. 4, a drawer 50 is moved to extend out of the upper storage compartment 33, the front end 72 of the first portion 68 of the L-shaped bar 60 first passes through a respectively aligned slot 98 to engage the lock bar 96. As the drawer 50 is moved to extend further out of the upper storage compartment 33 the inclination of the first portion 68 causes the engaged lock bar 96 to move away from the stop projection 90 in the direction of the arrow A in FIGS. 4 and 6 to move it to a locked position against the urging of the spring 102. Once, as seen in FIGS. 4–6, the lock bar 96 moves to the locked position, the slots 98 are out of alignment with the front ends 72 of the first portions 70 of all the L-shaped bars 60 of all the drawers 50 that remain totally within the upper storage compartment 33 and a solid portion of the lock bar 96 blocks the front ends 72 so that none of the drawers 50 totally within the upper storage compartment 33 can be removed therefrom. The lock bar 96 is maintained in the locked position by being engaged with either the first or second portions 68, 70 of the second legs 64 of the L-shaped bar 60, depending on how far the associated drawer 50 extends out from the upper storage compartment 33.

Once the extended drawer 50 is pushed totally back into the upper storage compartment 33 (FIG. 5), the L-shaped bar 60 is no longer engaged with the lock bar 96 and the spring 102 biases the lock bar 96 back to its unlocked position so the slots 98 are again aligned with the front ends 72 of the first portions 68 of all the second legs 64 of the L-shaped bars 60, so any drawer 50 can be removed from the upper storage compartment 33.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A cabinet comprising:

wall structure defining an open-faced compartment;

a plurality of drawers mounted in the compartment for movement from a first position totally within the compartment to a second position extending out of the compartment;

a lock bar movable between unlocked and locked positions, wherein in the locked position the lock bar prevents drawers disposed in the first position from moving to the second position;

biasing structure coupled to the lock bar and resiliently urging the lock bar toward the unlocked position; and actuation mechanism responsive to movement of one of the drawers to its second position for moving the lock bar to the locked position; and a stop structure engageable with the lock bar, wherein when the lock bar is engaged with the stop structure, the lock bar is maintained in the unlocked position.

2. The cabinet of claim 1, wherein the wall structure includes top and bottom walls, and the drawers are each upright and slideably coupled to at least one of the top and bottom walls.

3. The cabinet of claim 1, wherein the lock bar a plurality of openings, the actuation mechanism including an actuating projection on each drawer engageable with a respective one of the openings, wherein when the lock bar is in the unlock position each of the projections is aligned with a respective opening, wherein when one of the drawers is moved to the second position, the projection of the one drawer engages in its corresponding opening and moves the lock bar to the locked position wherein the other opening of the lock bar are out of alignment with the projections of the other drawers.

4. The cabinet of claim 1, wherein the lock bar is slidable in a first direction and each drawer is slidable in a second direction substantially perpendicular to the first direction.

5. The cabinet of claim 1, wherein the biasing structure is a spring.

6. An upstanding cabinet comprising:

top and bottom walls, first and second sidewalls connecting the top and bottom walls, the top and bottom walls and the first and second sidewalls defining an open-faced compartment;

a plurality of upright panels, each panel slidably coupled to at least one of the top and bottom walls and moveable from a first position within the compartment to a second position extending out of the compartment;

a lock structure moveable between locked and unlocked positions, wherein in the locked position the lock structure prevents movement of the panels from the first position to the second position; and actuation mechanism for coupling the lock structure to each of the panels so that movement of one of the panel from its first position moves the lock structure to the locked position; and a stop structure engageable with the lock structure, wherein when the lock structure is engaged with the stop structure, the lock structure is maintained in the unlocked position.

7. The cabinet of claim 6 and further comprising a biasing structure coupled to the lock structure and resiliently urging the lock structure toward the unlocked position.

8. The cabinet of claim 7, wherein the biasing structure is a spring.

9. The cabinet of claim 6, wherein the lock structure includes a lock bar having a plurality of openings, and the actuation mechanism includes an actuating projection on each of the panels engageable with a respective one of the openings, wherein when the lock structure is in the unlocked position each of the projections is aligned with a respective opening, wherein when one of the panels is moved to the second position, the projection of that panel engages in its corresponding opening and moves the lock structure to the locked position wherein the other openings of the lock bar are out of alignment with the projections of the other panels.

10. The cabinet of claim 9, and further comprising a channel coupled to the top wall and slideably supporting the lock bar.

11. The cabinet of claim 9, wherein the lock bar is slidable in a first direction and each panel is slidable in a second direction substantially perpendicular to the first direction.

12. A cabinet comprising:

wall structure defining an open-faced compartment;

a plurality of drawers mounted in the compartment for movement from a first position totally within the compartment to a second position extending out of the compartment;

a one-piece lock bar movable between unlocked and locked positions and having a plurality of openings, wherein in the locked position the lock bar prevents drawers disposed in the first position from moving to the second position;

biasing structure coupled to the lock bar and resiliently urging the lock bar toward the unlocked position; and actuation mechanism responsive to movement of one of said drawers to its second position for moving the lock bar to the locked position, the actuation mechanism including an actuating projection on each drawer engageable with a respective one of the openings, wherein when the lock bar is in the unlocked position each of the projections is aligned with a respective opening, wherein when one of the drawers is moved to the second position, the projection of the one drawer engages in its corresponding opening and moves the lock bar to the locked position wherein the other openings of the lock bar are out of alignment with the projections of the drawers.

13. The cabinet of claim 12, wherein each of the actuating projections includes a first portion and a second portion inclined with respect to the first portion, the first portion being aligned with a respective opening when the drawer is in the first position and the lock bar is in an unlocked condition.

14. The cabinet of claim 13, wherein each of the first and second portions is substantially bar-shaped, the first and second portions of each actuating projection being respectively substantially parallel to the first and second portions of other actuating projections when each of the drawers is in the first position.

15. The cabinet of claim 14, wherein each of the drawers has generally parallel top and bottom drawer walls and the actuating projection is disposed on one of the top and bottom drawer walls.

16. The cabinet of claim 12, wherein the wall structure includes top and bottom walls and further comprising a channel coupled to the top wall and slidably supporting the lock bar.

17. An upstanding cabinet comprising:

top and bottom walls, first and second sidewalls connecting the top and bottom walls, the top and bottom walls and the first and second sidewalls defining an open-faced compartment;

a plurality of upright panels, each panel slidably coupled to at least one of the top and bottom walls and moveable from a first position within the compartment to a second position extending out of the compartment;

a lock structure moveable between locked and unlocked positions and including a one-piece lock bar having a plurality of openings, wherein in the locked position the lock structure prevents movement of the panels from the first position to the second position; and actuation mechanism for coupling the lock structure to each of the panels so that movement of one of the panels from its first position moves the lock structure to the locked position, the actuation mechanism including an actuating projection on each of the panels engageable with a respective one of the openings, wherein when the lock structure is in the unlocked position each of the projections is aligned with a respective opening, wherein when one of the panels is moved to the second position, the projection of that panel engages in its corresponding opening and moves the lock structure to the locked position wherein the other openings of the lock bar are out of alignment with the projections of the other panels.

18. The cabinet of claim 17, wherein each actuating projection includes a first portion and a second portion inclined with respect to the first portion, each of the first portions being aligned with a respective opening when each of the panels is in the first position and the lock structure is in an unlocked condition.

19. The cabinet of claim 18, wherein each of the first and second portions is substantially bar-shaped, the first and second portions of each actuating projection being respectively substantially parallel to the first and second portions of other projections when each of the panels is in the first position.

20. The cabinet of claim 19, wherein each of the panels has generally parallel top and bottom panel walls and the projection is disposed on one of the top and bottom panel walls.

* * * * *

UNITED STATES PATENT AND TRADEMARK OFFICE

CERTIFICATE OF CORRECTION

PATENT NO : 6,113,200

DATED : May 26, 1999

INVENTOR(S) : Slivon, George R.

It is certified that error(s) appear in the above-identified patent and that said Letters Patent are hereby corrected as shown below:

Column 5, line 35, insert --has-- after "bar".
Column 5, line 44, "opening" should be --openings-- .
Column 5, line 65, "panel" should be --panels-- .
Column 6, line 54, insert --other-- after "the".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*